US005385251A

United States Patent [19]

Dunn

[11] Patent Number: 5,385,251

[45] Date of Patent: Jan. 31, 1995

[54] DISPOSABLE BOTTLE BAGS FOR USE WITH INFANT NURSING SYSTEM

[75] Inventor: Steven B. Dunn, Beverly Hills, Calif.

[73] Assignee: Munchkin Bottling Inc., Van Nuys, Calif.

[21] Appl. No.: 245,528

[22] Filed: May 18, 1994

Related U.S. Application Data

[63] Continuation of Ser. No. 60,233, May 11, 1993, abandoned.

[51] Int. Cl.[6] ..... A61J 9/00; A61J 9/06; B65D 23/02; B65D 33/24

[52] U.S. Cl. ..... 215/11.3; 215/11.1; 215/11.6; 383/35; 383/63; 383/65; 220/404

[58] Field of Search ..... 215/11.1, 11.3, 11.6, 215/11.4; 383/7, 35, 36, 211, 63, 65; 220/404

[56] References Cited

U.S. PATENT DOCUMENTS

| | | | |
|---|---|---|---|
| D. 310,417 | 9/1990 | Herritz | D24/48 |
| D. 315,601 | 3/1991 | McCoy et al. | D24/47 |
| 985,328 | 2/1911 | Decker | 215/11.3 X |
| 2,697,531 | 12/1954 | Hood | 215/11.1 X |
| 3,061,129 | 10/1962 | Fitzgerald | 215/11.3 |
| 3,117,874 | 1/1964 | Horan | 215/11.1 X |
| 3,204,855 | 9/1965 | Boynton et al. | 215/11.3 |
| 3,672,122 | 6/1972 | Berger et al. | 53/384 |
| 3,742,950 | 7/1973 | Endrody | 215/11.1 |
| 3,790,017 | 2/1974 | Fitzpatrick et al. | 215/11.3 |
| 3,822,806 | 7/1974 | Grimes | 215/11.3 |
| 4,201,299 | 5/1980 | Bumgarner et al. | 383/7 X |
| 4,238,040 | 12/1980 | Fitzpatrick | 215/11.3 |
| 4,339,046 | 7/1982 | Coen | 215/11 |
| 4,466,547 | 8/1984 | Klittich | 215/11.3 |
| 4,501,585 | 2/1985 | Friedman | 215/11.3 X |
| 4,523,377 | 6/1985 | Spletzer et al. | 29/773 |
| 4,600,104 | 7/1986 | Yanase | 383/35 X |
| 4,604,425 | 2/1987 | Cabernoch | 215/11.1 X |
| 4,686,814 | 8/1987 | Yanase | 383/36 X |
| 4,711,359 | 12/1987 | White et al. | 215/11.3 X |
| 4,869,912 | 9/1989 | McCoy et al. | 426/123 |
| 5,020,680 | 6/1991 | Bale | 215/11.6 |
| 5,108,195 | 4/1992 | Perron | 220/404 X |

FOREIGN PATENT DOCUMENTS

| | | | |
|---|---|---|---|
| 1003793 | 1/1977 | Canada . | |
| 3727321 | 3/1989 | Germany | 215/11.1 |
| 411234 | 11/1966 | Switzerland | 215/11.1 |

*Primary Examiner*—Sue A. Weaver
*Attorney, Agent, or Firm*—Woodcock Washburn Kurtz Mackiewicz & Norris

[57] ABSTRACT

Generally, an infant nursing system will include a holder having an open end, for holding and engaging a collapsible liquid containing bag. The collapsible bag defines a chamber and has an open end permitting fluid communication with the chamber. The open end is also used for engaging the open end of the holder. The novel bag may include flexible material, having a permeability sufficient to hold a fluid, wherein the flexible material is arranged in a generally tubular shape, defining a first end and a second end. The second end is sealed in a fluid tight fashion, thereby forming a chamber for holding fluid. The first end engages the open end of the holder. A pair of flaps is formed at the first end for assisting in opening the bag to provide access to the chamber. A gripping member is formed on the pair of flaps, for enhancing the gripping of the flaps. It is preferred for the gripping member to include holes formed in the flaps or textured surfaces. In an especially preferred embodiment, the bag further includes sealing members for releasably sealing the first end of the bag.

9 Claims, 3 Drawing Sheets

DISPOSABLE BOTTLE BAGS FOR USE WITH INFANT NURSING SYSTEM

This is a continuation of application Ser. No. 08/060,233, filed May 11, 1993, now abandoned.

FIELD OF THE INVENTION

The present invention relates generally to systems and devices for nursing or feeding infants and more particularly to disposable bottle bags for use in such systems.

BACKGROUND OF THE INVENTION

Nursing systems of the type in which the invention will find particular use are generally known and typically include a hollow tubular holder or nurser adapted at one end to receive a collapsible liquid-retaining bag and a nipple. The nipple and the collapsible bag are held in place by a retainer ring which is adapted to engage threads formed on the receiving end of the holder. Systems of this type are shown and described in U.S. Pat. Nos. 5,020,680—Bale; U.S. Pat. No. 4,238,040—Fitzpatrick; and U.S. Pat. No. 3,790,017—Fitzpatrick et. al.

In order to use such systems, a person must take a collapsible bag, gripping the open end with their fingers, insert the bag into the holder and pull a portion of the open end of the bag over the outside diameter of and onto the surface of the holder. A prior art bag 10 of the type used in such nursing systems is depicted in FIG. 1. Bag 10 is shown to include a body portion 12. Typically, bag 10 is constructed from thin plastic material having an open end 14 and a sealed end 16. A pair of flaps 18 is formed on the open end to assist in the mounting of bag 10 onto a holder.

Typically, persons using of such known systems for feeding infants have wet hands and fingers at the time of placing the collapsible bag shown in FIG. 1 onto the holder. Additionally, the bag itself may have condensation formed on the surface. If one has ever experienced the use of such devices, the task of pulling a portion of the open end of the bag over the outside diameter of the holder is extremely difficult. Wet hands and fingers in contact with the thin plastic material of flaps 18 results in an extremely slippery task, sometimes having very undesirable results.

Moreover, even if the bag is dry, for example, during the process of opening the collapsible bag in order to place fluid therein, persons experiencing difficulty, have a tendency to insert their fingers into the bag thereby spoiling the sterile condition of the bag.

Accordingly, a need still exists for a bag to be used in the nursing or feeding of infants, which bag can be easily mounted onto a bag holder even when the users hands and fingers are wet.

SUMMARY OF THE INVENTION

The previously described problems are overcome and the objects and advantages of the invention are achieved in a novel disposable bottle bag for use in an infant nursing system. Generally, an infant nursing system will include a holder having an open end, for holding and engaging a collapsible liquid containing bag. The collapsible bag defines a chamber and has an open end permitting fluid communication with the chamber. The open end is also used for engaging the open end of the holder. The novel bag may include flexible material, having a permeability sufficient to hold a fluid, wherein the flexible material is arranged in a generally tubular shape, defining a first end and a second end. The second end is sealed in a fluid tight fashion, thereby forming a chamber for holding fluid. The first end engages the open end of the holder. A pair of flaps is formed at the first end for assisting in opening the bag to provide access to the chamber. A gripping member is formed on the pair of flaps, for enhancing the gripping of the flaps. It is preferred for the gripping member to include holes formed in the flaps and/or textured surfaces. In an especially preferred embodiment, the bag further includes sealing members for releasably sealing the first end of the bag.

BRIEF DESCRIPTION OF THE DRAWINGS

The present invention will be better understood, and its numerous objects and advantages will become apparent by reference to the following detailed description of the invention when taken in conjunction with the following drawings, in which.

DETAILED DESCRIPTION

Figure 2:
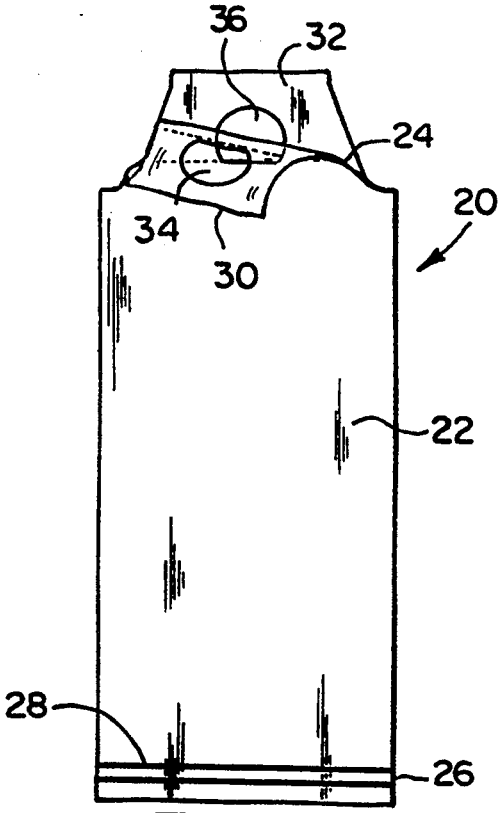
FIG. 2 is a front elevation of a bag constructed in accordance with the present invention.

A disposable bottle bag constructed in accordance with the present invention is depicted in FIG. 2 and generally designated 20. Bag 20 is shown to include a body portion 22 preferably formed from a flexible material, such as a thin plastic film. Bag 20 defines a chamber and has an open end 24 permitting fluid communication with the chamber. Open end 24 is also used for engaging the open end of a nurser or holder, explained in greater detail in connection with FIG. 4.

No particular material is required in order to practice the invention, however, the material must have a permeability sufficient to hold a fluid, such as breast milk, formula, etc. The flexible material is arranged in a generally tubular shape, defining a first end 24 and a second end 26. Second end 26 is sealed at 28 in a fluid tight fashion, thereby forming a chamber for holding fluid. First end 24 is for engaging the open end of a bag holder used in such system. The bag holder will be described in greater detail in relation to FIG. 4.

A pair of flaps 30 and 32 are formed at first end 24 for assisting in the opening of first end 24 to provide access to the inside of bag 20 or fluid chamber. A gripping member is formed on flaps 30 and 32, for enhancing the gripping of the flaps. As shown in FIG. 2, the gripping member includes openings 34 and 36. In the preferred embodiment holes 32 and 34 are semi-circular shaped and sized for an adult to get the end of their fingers through such holes. As indicated previously, persons using prior bags had a tendency to insert their fingers into the bag thereby spoiling a sterile container. By using holes 32 and 34, one may easily open bag 20 without touching the inside of the bag.

Figure 3:
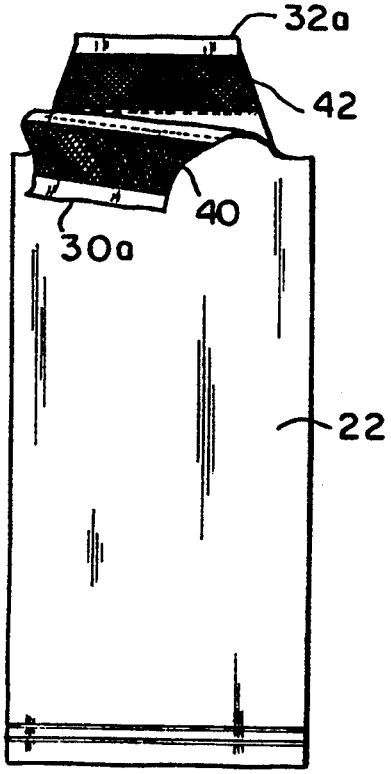
FIG. 3 is a front elevation of an alternate embodiment of a bag constructed in accordance with the present invention.

FIG. 3 discloses an alternate embodiment of bag 22, wherein the gripping member formed on flaps 30*a* and 32*a* includes textured surfaces 40 and 42. Such textured surfaces can be formed in any suitable fashion and can have any configuration suitable for increasing the gripping capacity of the flaps. For example, surfaces 40 and 42 can include a plurality of intersecting ridges or merely roughened surface.

Figure 5:
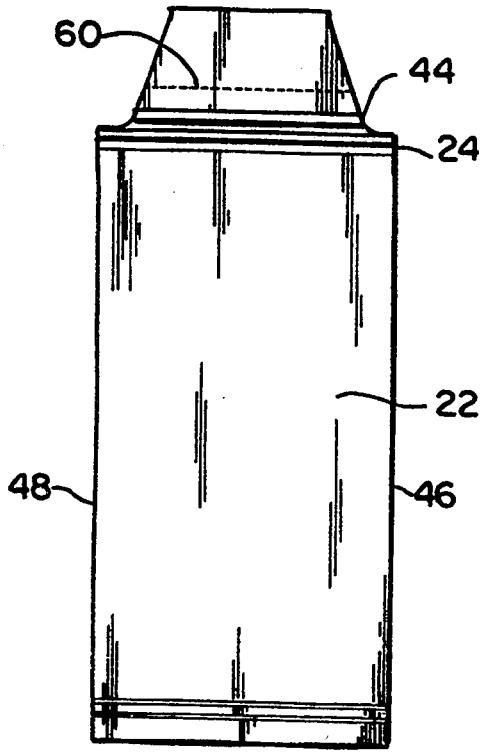
FIG. 5 is a front elevation of an alternate embodiment of a bag constructed in accordance with the present invention.

Referring now to FIG. 5, there is shown a still further embodiment of bag 22. Sealing members 44 are provided for releasably sealing first end 24. Although no particular sealing member is required in order to practice the invention, it is preferred for sealing members 44 to include cooperating projecting .members or ridges formed on each of side of first opening 24 which when pressed together the projecting members form a releasable seal. Seals of this kind are well known, however, the use of such a seal on a bag for use in an infant nursing system is novel. Sealing members 44 also help retain bag 22 on the holder when the open end of the bag is folded back over the holder, as can readily be visualized from FIG. 4.

Figure 6:
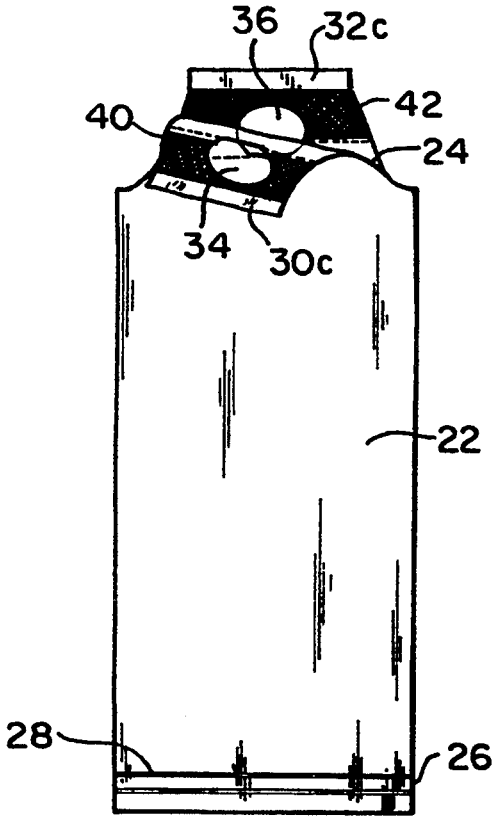
FIG. 6 is a front elevation of another alternate embodiment of a bag that is constructed in accordance with the present invention.

FIG. 6 illustrates a third embodiment of bag 22, wherein the gripping member formed on flaps 32*c* and 30*c* includes both openings 34, 36 and textured surfaces 40, 42.

It is noted that although breast feeding is generally recommended for a period of 2 years, many mothers return to work within about one or two months from giving birth. Consequently, mothers who wish to continue feeding "breast milk" to their infants must express milk and store it for later use. Prior collapsible bags, intended for such storage, provided a series of "twist tie" wires for that purpose. Such systems proved both cumbersome and inefficient. The use of a press lock sealing member is both easy to use as well as efficient.

Figure 1:
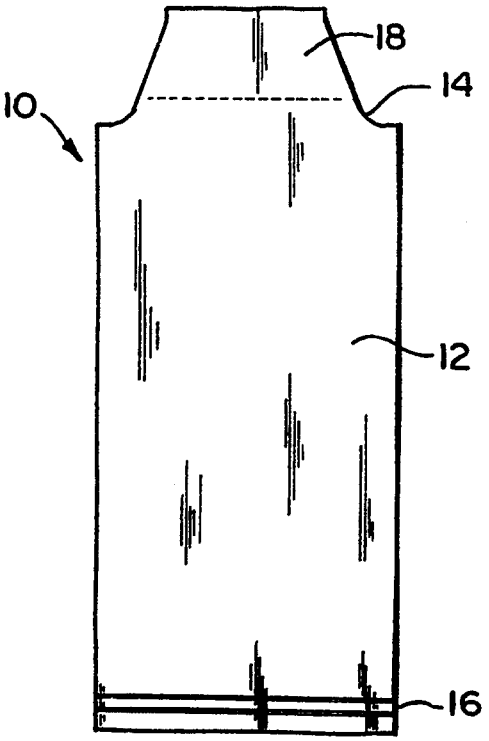
FIG. 1 PRIOR ART
FIG. 1 is a front elevation of a prior art bag intended for use in a nursing bottle.

Bag 20 is also shown to have perforations 60 formed in each of flaps 30 and 32. Although perforations .are shown in the prior bag depicted in FIG. 1, the novel addition of a gripping member, makes the removal of such flaps an easy operation.

It is noted that bag 22 can be formed from several forms of flexible material and that no one form is critical to the invention provided the bag is constructed for use within an infant nursing system. For example, bag 22 can be formed from a length of flexible plastic sleeve cut to a desired shape and sealed at one end. Alternatively, bag 22 can be formed from a rectangular shaped piece of flexible material, folded about in half to provide a fold line. In such an embodiment, the fold line forms second end 26. Such an arrangement will result in outer longitudinal edges 46 and 48, which longitudinal edges are joined to form a fluid tight seal. Still further, bag 22 may be formed from two separate pieces of plastic material sealed along all outer edges but one.

It is also noted that seal 28 and the sealing of edges 46 and 48 can be accomplished by any known method, so long as a fluid tight seal is obtained.

Figure 4:
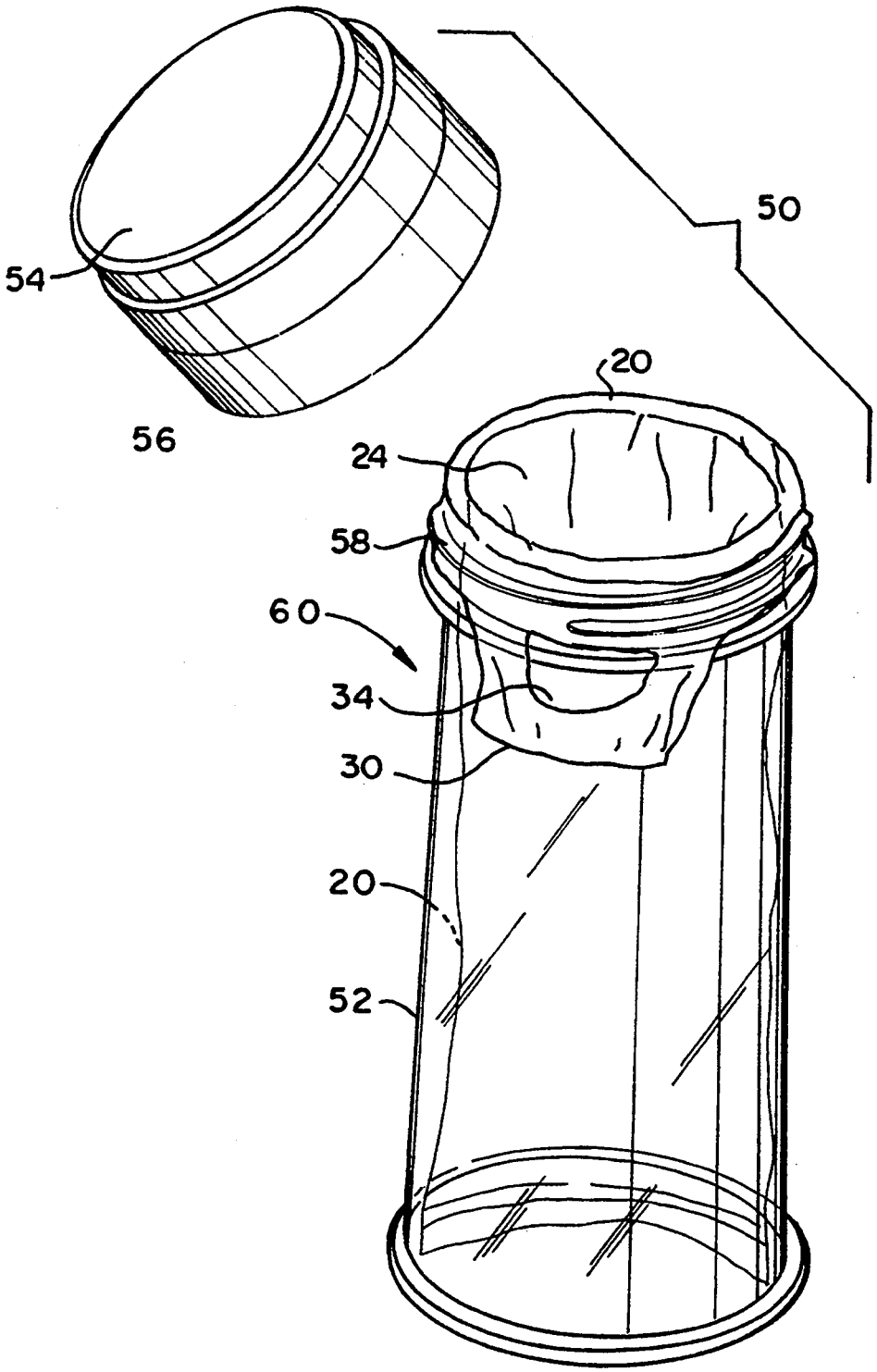
FIG. 4 is a perspective view of the bag of FIG. 2 mounted on a holder.

Consider now the use of bag 20 in nursing system 50 depicted in FIG. 4. A hollow tubular body or holder 52 is adapted at one end to receive bag 20 and a nipple 54 (shown as covered by a hood). The nipple and the collapsible bag are held in place by a retainer ring 56 which is adapted to engage threads 58 formed on the receiving end of holder 52. During use, a person would grip bag 20 by inserting his or her finger tips through holes 34 and 36 (not specifically depicted in FIG. 4) and opening end 24 of bag 20. Flaps 30 and 32 would be pulled outward and a portion of bag 20 would be pulled over the top of and the outside diameter of holder 52. Engagement of retainer ring 56 with threads 58 would serve to hold bag 20 in place during feeding. Once bag 20 is positioned as shown in FIG. 4, or after retaining ring 56 has been attached to holder 52, a user may remove flaps 30 and 32 by again inserting their 5 finger tips through holes 34 and 36 and pulling the flaps or tabs off.

While the invention has been described and illustrated with reference to specific embodiments, those skilled in the art will recognize that modifications and variations may be made without departing from the principles of the invention as described hereinabove and set forth in the following claims.

What is claimed is:

1. A collapsible bag for use in an infant nursing system, wherein said system includes a bag holder having an open end, said bag comprising:

a bag, having a permeability sufficient to hold a fluid and having an open end, said bag defining a chamber and said open end permitting fluid communication with said chamber and for engaging said open end of said holder;

a pair of flaps formed at said open end of said bag for assisting in the opening of said bag to provide access to said chamber; and a finger hole defined in each of said flaps for permitting a user to grip and pull said flaps apart by inserting two fingers, respectively, in said finger holes, whereby a user can conveniently install said bag in a bag holder without contaminating an inside surface of said bag by finger contact.

2. The bag of claim 1, wherein the hole formed in each of said flaps is semi-circular shaped.

3. The bag of claim 1, wherein said bag further comprises sealing members for releasably sealing said open end of said bag.

4. The bag of claim 3, wherein said sealing members comprise cooperating projecting members formed on each of said flaps which when said projecting members are pressed together form a releasable seal.

5. The bag of claim 1, wherein said collapsible bag comprises a length of a flexible plastic sleeve sealed at one end.

6. The bag of claim 1, wherein said flaps have perforations enabling said flaps to be torn away.

7. A collapsible bag for use in an infant nursing system, wherein said system includes a bag holder having an open end, said bag comprising:

a bag, having a permeability sufficient to hold a fluid and having an open end, said bag defining a chamber and said open end permitting fluid communication with said chamber and for engaging said open end of said holder;

a pair of flaps formed at said open end of said bag for assisting in the opening of said bag to provide access to said chamber; and gripping means defined on each of said flaps for permitting a user to grip and pull said flaps apart, said gripping means comprising a finger hole defined in each of said flaps for permitting a user to grip and pull said flaps apart by inserting two fingers, respectively, in said finger holes, and a textured surface formed on each of said flaps for permitting a user to grip and pull said flaps apart by gripping said flaps, respectively, at said textured surfaces, whereby a user can conveniently install said bag in a bag holder without contaminating an inside surface of said bag by finger contact.

8. An improved system for nursing an infant, comprising:

an elongated holder having a space defined therein and an opening defined at at least one end communicating with said space;

a collapsible bag that is sized and shaped to fit within said space in said elongated holder when in an expanded condition, said collapsible bag having an open end, said collapsible bag further having a permeability that is suitable for storing liquid nourishment for an infant therein, said collapsible bag further being removable from said holder;

a pair of oppositely facing sealing members provided at said open end of said collapsible bag, said sealing members comprising cooperating projecting members that, when pressed together, seal said open end of said collapsible bag for convenient storage of the liquid nourishment contained therein when said collapsible bag is removed from said holder, said sealing members further serving to help retain said collapsible bag on said holder when said open end of said collapsible bag is folded back over said one end of said holder having said opening; and nipple means for mounting to said elongated holder and communicating with said collapsible bag during feeding.

9. A collapsible bag assembly for use in an infant nursing system, wherein said system includes a holder having a space defined therein and an opening defined at at least one end communicating with said space, comprising:

a collapsible bag having an open end, said collapsible bag further having a permeability that is suitable for storing liquid nourishment for an infant therein; and a pair of oppositely facing sealing members provided at said open end of said collapsible bag, said sealing members comprising cooperating projecting members that, when pressed together, seal said open end of said collapsible bag for convenient storage of the liquid nourishment contained therein, said sealing members further serving to help retain said collapsible bag on the holder when said open end of said collapsible bag is folded back over the end of the holder having the opening, whereby nourishment such as breast milk can be stored as quickly, as conveniently and as hygienically as possible.

* * * * *